US005783314A

United States Patent [19]

Yamagiwa et al.

[11] Patent Number: 5,783,314

[45] Date of Patent: Jul. 21, 1998

[54] SLIDING COMPONENT AND PRODUCTION METHOD THEREOF

[75] Inventors: Masamichi Yamagiwa; Takao Nishioka; Hisao Takeuchi; Akira Yamakawa, all of Hyogo, Japan

[73] Assignee: Sumitomo Electric Industries, Ltd., Japan

[21] Appl. No.: 716,446

[22] PCT Filed: Jun. 17, 1996

[86] PCT No.: PCT/JP96/01660

§ 371 Date: Sep. 19, 1996

§ 102(e) Date: Sep. 19, 1996

[87] PCT Pub. No.: WO97/00374

PCT Pub. Date: Jan. 3, 1997

[30] Foreign Application Priority Data

Jun. 19, 1995 [JP] Japan ..... 7-151813

[51] Int. Cl.[6] ..... B32B 18/00; B32B 15/00; C21D 1/00

[52] U.S. Cl. ..... 428/627; 148/516

[58] Field of Search ..... 148/516, 644; 428/627

[56] References Cited

FOREIGN PATENT DOCUMENTS

| | | |
|---|---|---|
| 61-103057 | 5/1986 | Japan . |
| 225728 | 9/1988 | Japan . |
| 289306 | 11/1988 | Japan . |
| 24 553 | 1/1990 | Japan . |
| 55809 | 2/1990 | Japan . |
| 110064 | 5/1991 | Japan . |
| 12069 | 1/1992 | Japan . |
| 203206 | 7/1992 | Japan . |
| 314903 | 11/1992 | Japan . |
| 692749 | 5/1994 | Japan . |
| 847823 | 2/1996 | Japan . |

OTHER PUBLICATIONS

PCT/ISA/210 Jul. 1992.

*Primary Examiner*—Deborah Yee
*Attorney, Agent, or Firm*—Bierman, Muserlian and Lucas

[57] ABSTRACT

This invention aims at providing a sliding component having a crowning shape formed by applying surface quenching treatment to a portion made of a steel, and a production method thereof. The shape and the quantity of crowning can be controlled by heat-treatment or machining after the surface quenching. The sliding component may be made of a steel alone, or may be formed in such a manner that at least one portion of members forming the crowning-shaped sliding face by the surface quenching is joined or fitted to a sliding component main body made of the steel, and its material is a ceramic.

18 Claims, 4 Drawing Sheets

SLIDING COMPONENT AND PRODUCTION METHOD THEREOF

TECHNICAL FIELD

This invention relates to sliding components having a plurality of sliding faces, for which wear resistance is requisite, such as a tappet, a rocker arm and other engine components, bearings, and so forth, and a production method of such sliding components.

BACKGROUND ART

In order to prevent uneven contact due to poor alignment, one of a pair of sliding faces of a mechanical sliding component generally is not a flat face but has a convexed crowning shape such that its center portion is slightly higher than its outer edge portion (by several to dozens of microns).

This crowning shape is formed by various methods such as machining (polishing), a method described in Japanese Patent Laid-Open No. 63-289306 which fits metal over ceramic so as to cause elastic deformation of the ceramic by its fastening force, a method described in Japanese Patent Laid-Open No. 63-225728 which heats and joins ceramic that form a sliding face to a metal as a main body and utilizes the difference of their thermal expansion coefficients, and a method which shapes in advance a calcined body into a crowning shape, then sinters this calcined body and utilizes the as-sintered face as the sliding face ["Automobile Technology", Vol. 39, No. 10, (1985) p1184], and so forth.

However, since the crowning shape is a three-dimensional shape, formation of this shape by machining requires an enormous cost of production.

According to the method which fits metal over ceramic or the method which utilizes the difference of thermal expansion coefficients between ceramic and metal, the crowning quantity is limited once the structure, the heating temperature, etc, are decided.

On the other hand, the method which shapes in advance the calcined body into the crowning shape, then sinters it and utilizes the as-sintered face as the sliding face is not free from the problem that the face shaped into the crowning shape undergoes deformation due to shrinkage at the time of sintering, and dimensional accuracy drops.

In view of the problems of the prior art described above, the present invention aims at providing a sliding component having improved utility and a method of producing such a sliding component.

DISCLOSURE OF THE INVENTION

The sliding components provided by the present invention for accomplishing the object described above are as follows:

1) a sliding component wherein the sliding face of at least one portion has a crowning shape by applying partially surface quenching treatment to a portion made of a steel;
2) a sliding component whose crowning quantity is changed by heat-treatment or machining of a steel portion conducted after the surface quenching; and
3) at least one portion of the member forming the sliding face in the shape of crowning by surface quenching described above is formed by joining or fitting.

The methods of producing the sliding components described above are as follows:

1) a method which applies partially surface quenching treatment to a portion, constituted by a steel, of a sliding component main body in order to shape a sliding face into a crowning shape;
2) a method which conducts heat-treatment or machining of a steel portion so as to change the crowning quantity after the surface quenching; and
3) a method which joins or fits a member for forming a sliding face to a sliding component main body.

It is more preferred to use ceramics for the member for forming the sliding face which is formed by joining or fitting.

MODE OF OPERATION

In the sliding component according to the present invention, the crowning shape is formed on the sliding face of at least one portion by partially applying surface quenching to a steel which constitutes the sliding component and is hardenable.

In other words, deformation is partially generated by utilizing volume expansion due to martensitic transformation or so-called quenching distortion at the time of surface quenching, and the crowning shape is imparted to at least one arbitrary sliding face in the sliding component.

The portion to which surface quenching is applied is appropriately selected in accordance with the position of the sliding face to which crowning is imparted, or with the crowning quantity. Crowning by surface quenching is imparted by utilizing the phenomenon described above. Accordingly, it is more efficient to apply surface quenching to the portion or portions near the joined portion or portions in a broader range. Incidentally, the total surface area of surface quenched is preferably at least 30% of the surface area as the difference obtained by subtracting the surface area of the portion, which is shaped into the crowning shape, from the entire surface of the component.

The crowning quantity to be imparted can be broadly controlled in accordance with the means and methods (heating, cooling time, etc) of surface quenching, with the kinds of steel materials used and so on.

The portion to which surface quenching is applied is hardened and has low wear and high durability. At the same time, it plays the role of the sliding portion.

There is no limitation to the kind of the steel to which surface quenching treatment is applied, so long as the steel undergoes hardening by the surface quenching treatment. From the aspects of strength, and the costs of material and machinability, however, carbon steels widely used as the steels for machine structural use and alloy steels containing Ni, Cr and Mo as the alloy elements are preferred.

According to the present invention, the crowning quantity is changed by applying heat-treatment to the sliding component subjected to the surface quenching treatment. This utilizes release of the residual stress occurring due to the surface quenching or the change of an unstable structure formed by quenching such as martensite. Heat-treatment may be applied either wholly or partially, and is selected in accordance with the position, the quantity and the shape of the crowning which is to be changed.

Suitable hardness and toughness in accordance with the object of use can be provided by carrying out this heat-treatment as tempering treatment of the hardened portion. Since the residual stress can be removed, the change of the crowning quantity with aging and the crack of the hardened portion can be prevented.

In the sliding component according to the present invention, the crowning quantity is changed by applying machining to the steel portion after the surface quenching treatment. The sliding component keeps its crowning shape because various residual stresses such as quenching distortion balance with one another. Therefore, this balance is lost by changing the rigidity by machining or removing the residual stress layer, and the crowning quantity can be changed in this way.

The machining position is suitably selected in accordance with the position and the quantity of crowning to be changed. This machining may be used as machining for forming the sliding portion for which high dimensional accuracy as well as surface roughness are naturally required.

A member having excellent sliding characteristics may be joined or fitted to the sliding component main body for the portion for which sliding characteristics are particularly required. In this case, release of the residual stress occurring by joining or fitting is encountered in heat-treatment or machining after the quenching. Therefore, the change quantity of crowning can be made over a broad range.

The member which is fitted to the sliding component main body and forms the sliding face is particularly preferably a ceramic material having excellent sliding characteristics and high heat resistance.

Ceramic materials having high strength such as aluminum oxide ($Al_2O_3$), zirconium oxide ($ZrO_2$), silicon nitride ($Si_3N_4$), etc. are more preferred. These ceramic materials must have a four-point flexural strength of at least 50 kg/mm$^2$ according to JIS standard and a thermal shock resistance to a temperature difference (thermal shock resistance temperature difference) of at least 400° C. Particularly preferred among them is the $Si_3N_4$ ceramic material which exhibits excellent performance.

Further preferably, silicon nitride type ceramics having a strength value at room temperature of at least 100 kg/mm$^2$ for test pieces for four-point flexural test according to the JIS standard and a thermal shock resistance against to a temperature difference of at least 800° C. are used.

When the ceramics and the steel are joined at the portion near the portion of surface quenching treatment, the treatment condition is adjusted by, for example, reducing the temperature of the joined portion to a lower temperature than the temperature at the time of joining so as to keep the joined state and the joining strength, but there is the case where the temperature of the joined portion rises near to the joining temperature due to the restrictions such as the shapes. Therefore, in order to avoid deterioration of the strength after thermal impact due to cooling (oil cooling, etc), the ceramics should have a thermal shock resistance withstanding a temperature difference of at least 400° C., most reliably at least 800° C.

When silicon nitride type ceramics having a strength of at least 100 kg/mm$^2$, preferably at least 130 kg/mm$^2$ are selected as such high strength ceramics, the ceramics can withstand the stress occurring thereinside and the occurrence of cracks can be easily prevented even when surface quenching treatment is applied to the portion near the joining portion.

Next, the production method of the sliding component according to the present invention will be explained.

The surface quenching treatment is carried out by using known quenching methods by radio frequency, flame, laser beam, electron beam, and so forth.

Where toughness must be secured at the portion to be quenched, a steel main body which is in advance subjected to carburization treatment may be employed.

Heat-treatment after the surface quenching is carried out at a temperature within the range of 100° to 700° C. If the temperature is lower than 100° C., the change of crowning hardly occurs and if it is higher than 700° C., an austenite structure will develop and will break the structure generated by quenching. The temperature range is more preferably 150° to 600° C.

Machining of the steel portion after the surface quenching is made by known machining methods such as cutting. Particularly when a quenched sliding portion is employed, a surface layer called a mill scale must be removed and deformation due to quench distortion must be eliminated so as to conduct high precision machining. When a surface roughness is adjusted suitably to a lower level, polishing may be employed.

When the member for forming the sliding face is fitted to the sliding component main body, joining and fitting may be employed. Known joining methods such as heat-joining, e.g. brazing or diffusion joining, welding, pressure joining, etc. may be utilized.

The temperature of heat-joining is most preferably at least 800° C. so as to eliminate the influences of the temperature rise at the time of surface quenching treatment.

In other words, the position of surface quenching is preferably selected so as not to exceed the temperature at the time of heat-joining, and in the case of quenching using the electron beam or the laser beam having less heat diffusion at the time of surface quenching, quenching can be applied to the portion near the joined portion, and the area that can be surface-quenched can be increased.

In the case of flame hardening and induction hardening, on the other hand, the heat affected portions become greater. Therefore, it becomes difficult to apply hardening to the portion near the joined portion. In the case of induction hardening, for example, the hardening range is preferably spaced apart by several millimeters from the joined portion, though it varies depending on the heating time and the frequency.

When the member to be joined is ceramic, joining by brazing is effected. When the ceramic is directly joined to the metal, the brazing material is a Ti—containing silver brazing such as an Ag—Cu—Ti type, an Ag—Ti type, etc. When the member is metallized on the joined face side of the ceramic, an Ag—Cu type brazing is preferred.

The brazing atmosphere is preferably a non-oxidizing atmosphere (vacuum and Ar, $N_2$, $H_2$ and their mixed gases). Fitting may be carried out by known methods such as press fit, shrinkage fit, and so forth.

EXPLANATION OF REFERENCE NUMERALS

A: upper limit of quenching range

1: valve lifter

2: tappet main body

Figure 1:
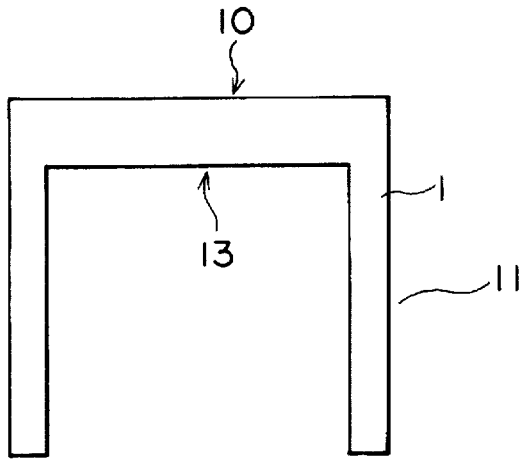
FIG. 1 is a longitudinal sectional view of a valve lifter.

3: sliding member
4: valve lifter main body
5: sliding member
10: sliding face
11: outer peripheral face
12: hemispherical face
13: inner bottom face
14: outer peripheral face of neck portion

BEST MODE FOR CARRYING OUT THE INVENTION

Example 1

FIG. 1 shows a valve lifter produced as an example of sliding components according to the present invention.

An alloy steel chromium-molybdenum steel SCM440 (JIS G4105) for machine structural use was used for the valve lifter 1.

The overall dimensions included an outer diameter of ϕ25 mm, an inner diameter of ϕ22 mm, a total height of 25 mm and an inner height of 20 mm.

The valve lifter 1 was oil-cooled from 850° C., was tempered by quenching from 550° C. and was thereafter machined so that a face 10 as a sliding face had a flatness of 3 μm and a surface roughness of not greater than 1.6 μm (JIS ten-point mean roughness).

An outer peripheral face 11 was heated by a kHz frequency of 300 within the range of 6, 12, 18 and 25 mm, in terms of the entire length measured from an open portion on the outer peripheral face and samples having different heating ranges were so obtained. The whole valve lifters of these samples were immediately cooled with water and were quenched.

The faces 10 after quenching have shapes, as the mean of twenty samples, such that their center portion swelled out in comparison with the outer edge portion by the values indicated in Table 1 in the spherical face. Incidentally, the term "outer edge portion" used hereby means the portion having a diameter of 21 mm.

TABLE 1

| quenching range (mm) | surface quenching area percentage (%) | crowning quantity (μm) |
|---|---|---|
| 6 | 12 | 0 |
| 12 | 25 | 0 |
| 18 | 37 | 6 |
| 25 | 51 | 10 |

The inner bottom face 13 of a sample having the quenching range of 25 mm was similarly induction hardened, and in this instance, the heating time was changed to 2, 4, 6 and 8 seconds. The change quantity of the crowning quantities (swell-out quantity) before and after the hardening of the inner bottom face were 5, 3, −1 and −3 μm, respectively, as the mean of five samples.

Further, the samples having the heating time of 2 seconds were tempered in an oil bath at 200° C., and the outer periphery of each sample was finished to ϕ24.8 mm by a centerless grinder. The crowning increased by 2 μm after tempering and by 2 μm after machining, as the mean of five samples.

Example 2

Figure 2:
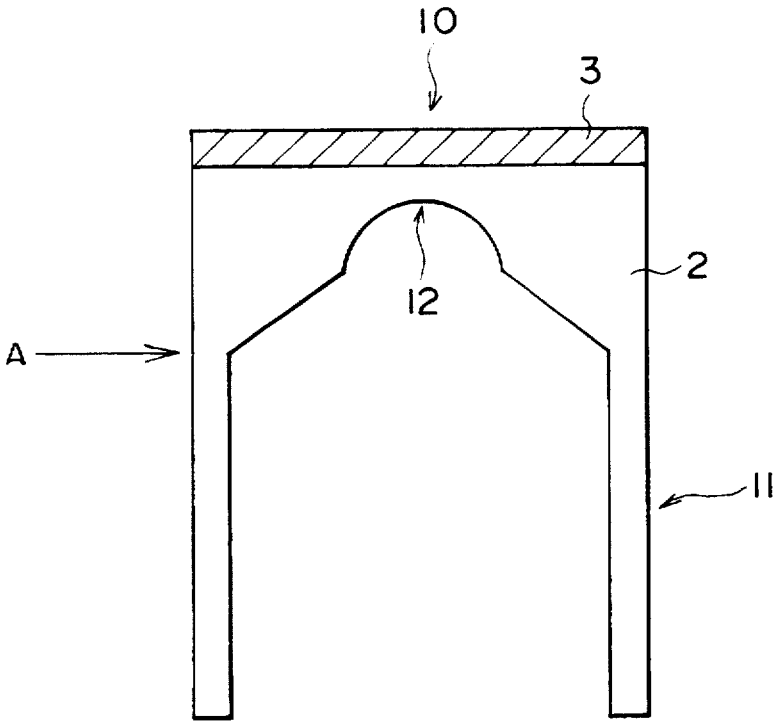
FIG. 2 is a longitudinal sectional view of a tappet.

FIG. 2 shows a tappet produced as an example of the sliding components according to the present invention.

An alloy steel nickel-chromium steel SNC836 for machine structural use (JIS G4102) was used for the tappet main body 2. The dimensions of this sliding component included a diameter of ϕ30 mm, a hollow portion of ϕ25 mm in an inner diameter and a total height of 40 mm. A commercially available silicon carbide (SiC) ceramic and a cemented carbide having a diameter of ϕ30 mm and a thickness of 1.5 mm were used for a sliding member 3 that formed the sliding face 10 according to the present invention, and the face 10 as the sliding face was machined into a flatness of 5 μm and a surface roughness of not greater than 1.6 μm (ten-point mean roughness).

Joining of the sliding member 3 to the tappet main body 2 was carried out by holding them in vacuum at 860° C. for 30 minutes through an Ag—Cu—Ti type brazing material having a thickness of 50 μm. The outer peripheral face 11 was heated by an electron beam at an accelerated voltage of 6 kV and quenched. The crowning quantity of the spherical shape of the center portion with respect to the outer peripheral edge portion (ϕ25 mm) increased by 9 and 4 μm, respectively, as the mean of twenty samples due to the surface quenching treatment in both SiC and the cemented carbide in the shape of the face 10, and the total crowning quantity was 29 μm and 22 μm.

Example 3

A tappet having the same shape as that of the tappet of Example 2 was produced in the following way.

An alloy steel chromium steel SCr440 (JIS G4104) for machine structural use was used for the tappet main body 2, and the sliding member 3 made of $Si_3N_4$ was produced in the following way.

To commercially available $Si_3N_4$ powder were added 5 wt. % of $Y_2O_3$ powder and 2 wt. % of $Al_2O_3$ powder as sintering aids, and they were mixed in ethanol by using a ball mill for 96 hours. After drying, the resulting powder mixture was press-molded and further subjected to CIP. Thereafter, it was sintered at 1,710° C. for 4 hours in a nitrogen atmosphere of 2 atms, and was next subjected to HIP treatment at 1,660° C. for 1 hour in the nitrogen gas atmosphere of 1,000 atms.

The resulting sintered body had an alpha (α) percentage of 11% and 155 crystal grains per a 50 μm length as a linear crystal grain density. The alpha (α) percentage was determined from a peak intensity ratio, that is, $\alpha[(102)+(210)]/\{\alpha[(102)+(210)]+\beta[(101)+(210)]\}$, wherein (102)+(210) and (101)+(210) are peak intensities of (α-silicon nitride and α'-sialon), (β-silicon nitride and β'-sialon), respectively in X-ray diffraction patterns. The mechanical properties of the sintered body are shown in Table 2.

TABLE 2

| flexural strength | mechanical characteristics |
|---|---|
| thermal shock resistance temperature difference | 145 kg/mm$^2$ 860° C. |

A blank having a diameter of 30 mm and a thickness of 1 mm was cut out from the resulting sintered body, and the face 10 as the sliding face was machined into a flatness of 5 μm and a surface roughness of not greater than 1.6 μm (ten-point mean roughness). The blank was then brazed to the tappet main body 2 by holding them in vacuum at 1,000° C. for 30 minutes through an Ag—Ti type brazing material having a thickness of 50 μm.

The surface of the outer peripheral face 11 of the tappet so brazed was heated from the open portion to the A portion (25 mm from the open portion) by the radio frequency (400 kHz) in the same way as in Example 1, and the whole tappet was immediately thereafter cooled with water. Subsequently, the hemispherical face 12, too, was quenched (nheating time: 5 seconds) by radio frequency and was then cooled with water.

After the surface quenching treatment, the spherical crowning quantity (the change quantity of crowning) of the center portion with respect to the outer edge portion (ϕ25 mm) of the sliding face increased by 8 μm as the mean of twenty samples when only the face 11 was quenched, and the total crowning quantity was 32 μm. When the face 12 was quenched, too, the crowning quantity further increased by 12 μm.

Example 4

In Example 3, the quenching range of the outer peripheral face 11 was changed to 5, 15, 25 and 30 mm in terms of the distance from the open portion. As a result, the change quantity of crowning due to the quenching of the outer peripheral face became as tabulated in Table 3.

TABLE 3

| quenching range (mm) | surface quenching area percentage (%) | crowning change quantity (μm) |
|---|---|---|
| 5 | 7 | 0 |
| 15 | 21 | 0 |
| 25 | 35 | 8 |
| 30 | 42 | 11 |

Example 5

In Example 3, quenching of the hemispherical face 12 was carried out by changing the heating time to 3, 7 and 9 seconds. As a result, the change quantity of crowning after the quenching of the outer peripheral face was 16, 5 and −2 μm, respectively, as the mean of twenty samples.

Example 6

The tappet of Example 3, which had been induction hardened, was heat-treated (tempered) in an oil bath at 200° C. As a result, the change quantity of crowning after the hardening of the outer peripheral face 11 was 5 μm as the mean of twenty samples.

Example 7

Figure 3:
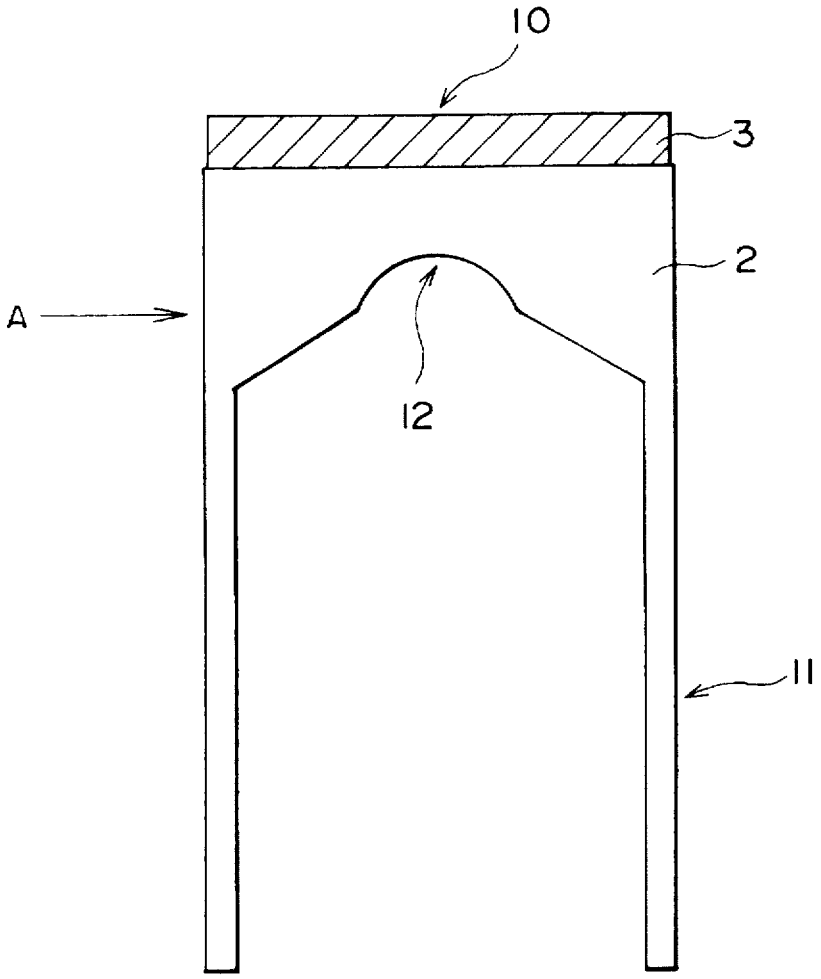
FIG. 3 is a longitudinal sectional view of a tappet.

FIG. 3 shows a tappet produced as an example of the sliding components according to the present invention.

An alloy steel nickel-chromium steel SCM435 (JIS G4105) for machine structural use was used for the tappet main body 2. The dimensions of the sliding component included a diameter of ϕ31 mm, a hollow portion of ϕ27 mm in an inner diameter, and a total height of 55 mm. The silicon nitride produced in Example 3 was machined into a diameter of ϕ30 mm and a thickness of 1.3 mm to obtain a sliding member 3. The face 10 as the sliding face was polished into a flatness of 3 μm and a surface roughness of not greater than 0.8 μm (ten-point mean roughness).

Joining of the sliding member 3 to the tappet main body 2 was carried out by holding them in vacuum at 880° C. for 40 minutes through an Ag—Cu—Ti type brazing material having a thickness of 50 μm.

The surface of the outer peripheral face 11 of the tappet so brazed was heated from its open portion to the A portion by radio frequency in the same way as in Example 3, and the whole tappet was cooled thereafter immediately with water. Subsequently, the hemispherical face 12, too, was hardened by radio frequency and was cooled with water. After tempering was conducted in an oil bath at 150° C., the tappet main body 2 was machined into ϕ30.5 mm by centerless grinding. As a result, the change quantity of crowning after tempering was 6 μm as the mean of twenty samples. Incidentally, crowning was measured as a difference in level between the center portion and the outer peripheral portion (ϕ25 mm).

Example 8

Figure 4:
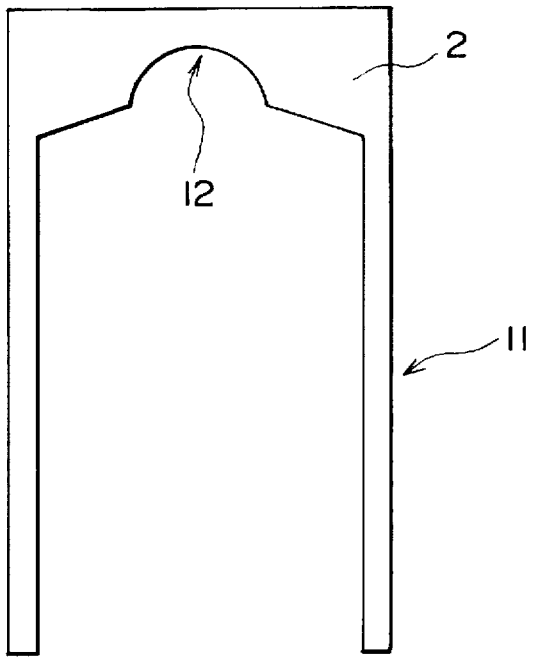
FIG. 4 is a longitudinal sectional view of a tappet main body.

FIG. 4 shows a tappet main body 2 produced as an example of the sliding components according to the present invention. An alloy steel nickel-chromium steel SNC631 (JIS G4102) for machine structural use was used as the material. The dimensions of the sliding component included a diameter of ϕ25.5 mm, a hollow portion of ϕ22 mm in an inner diameter and a total height of 45 mm. The silicon nitride produced in Example 3 was machined into a sliding member having a diameter of ϕ24.5 mm and a thickness of 1.2 mm, and the face 10 as the sliding face was polished into a flatness of 3 μm and a surface roughness of not greater than 0.8 μm (ten-point mean roughness).

Joining of the sliding member 3 to the tappet main body 2 was carried out by holding them in a vacuum at 1,100° C. for 20 minutes through an Ag—Ti type brazing material having a thickness of 50 μm.

Figure 5:
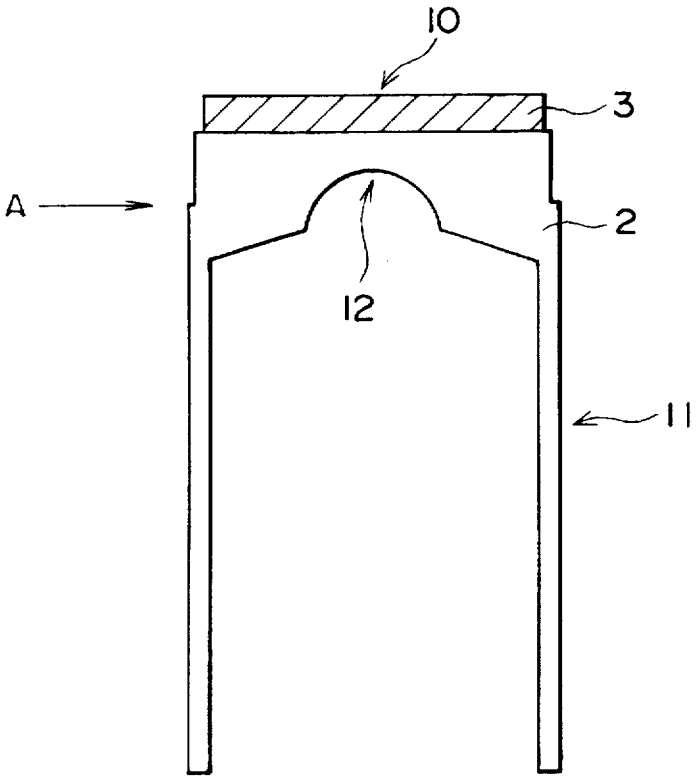
FIG. 5 is a longitudinal sectional view of a tappet.

The surface of the outer peripheral face 11 of the tappet so brazed was heated from the open portion to the A portion by radio frequency in the same way as in Example 3 and immediately thereafter, the whole tappet was cooled with water. Subsequently, the hemispherical face 12, too, was quenched by radio frequency and was then cooled with water. After the tappet was tempered in an oil bath at 150° C., the tappet steel portion was machined to ϕ25.0 mm by centerless grinding. Thereafter, the portion near the joined portion was machined and finished to ϕ24.75 mm as in FIG. 5. As a result, crowning of the samples, which were machined at the portion near the joined portion, increased by 5 μm than those which were not machined, as the mean of twenty samples. Incidentally, crowning was measured as the difference in level between the center portion and the outer edge portion (ϕ25 mm).

Example 9

Figure 6:
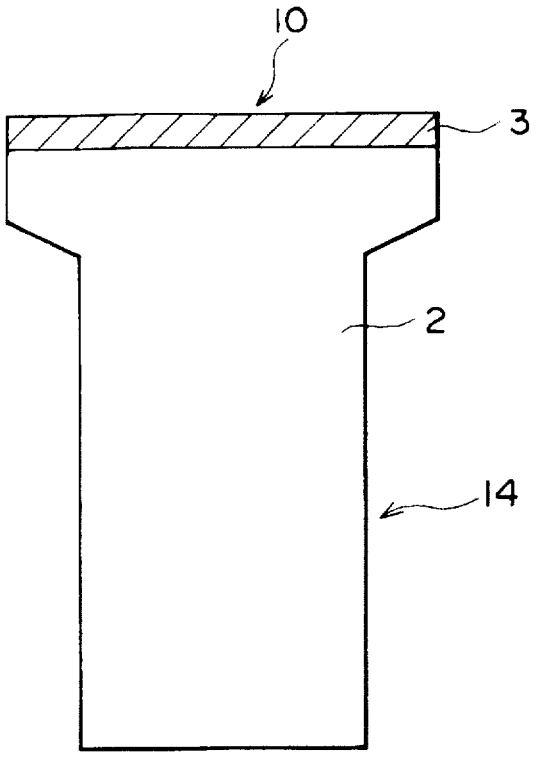
FIG. 6 is a longitudinal sectional view of a tappet.

FIG. 6 shows a tappet produced as an example of the sliding components according to the present invention. The sliding member had a dimension of an umbrella portion having a diameter of ϕ30 mm, a neck portion having a diameter of ϕ17 mm and a total height of 45 mm. The silicon nitride produced in Example 3 was machined into the sliding member 3 having a diameter of ϕ30 mm and a thickness of 1.2 mm. The flatness of the face 10 and its surface roughness were the same as those of Example 3.

An alloy steel nickel-chromium-molybdenum steel SNCM616 (JIS G4103) for machine structural use, which had been subjected to carburizing treatment (carburization depth: 0.5 mm) was used for the tappet main body 2. However, the carburizing layer on the joined face with the sliding member 3 was removed by machining. Joining to the sliding member 3 was carried out by holding the tappet main body 2 and the sliding member 3 in vacuum at 860° C. for 10 minutes through an Ag—Cu—Ti type brazing material having a thickness of 70 μm. On the other hand, a commercially available cemented carbide was machined in the same way as the silicon nitride, and was joined to the tappet main body 2 at 1,050° C. by diffusion joining.

The outer periphery 14 of the neck portion of the tappet so brazed was heated by radio frequency, and the entire tappet was cooled immediately thereafter with water. As a result, crowning increased by 10 μm and 7 μm, respectively, due to the quenching as the mean of twenty samples in the silicon nitride and the cemented carbide.

Example 10

Figure 7:
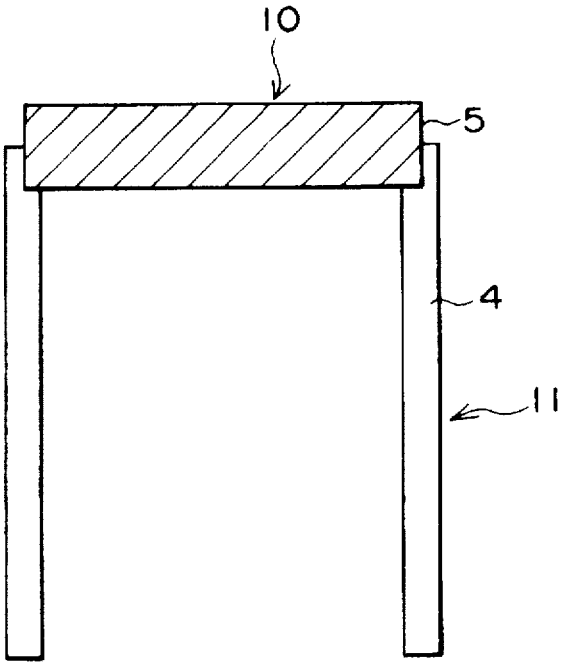
FIG. 7 is a longitudinal sectional view of a valve lifter.

FIG. 7 shows a valve lifter produced as an example of the sliding components according to the present invention. An alloy steel nickel-chromium-molybdenum steel for machine structural use SNCM439 (JIS G4103) was used for the valve lifter main body 4. The dimensions of the sliding component included a diameter of ϕ30 mm and a total height of 40 mm.

The sliding face 10 is formed according to the present invention. A commercially available silicon nitride ceramic, a cemented carbide and the silicon nitride ceramic produced in Example 3, each having a diameter of ϕ27.5 mm and a thickness of 6 mm, were used for the sliding member 5, and each was fitted with a press-in margin of 50 μm. The face 10 as the sliding face was machined in the same way as in Example 2.

The outer peripheral face 11 was heated by an electron beam at an accelerated voltage of 7 kV for quenching. The shape of the sliding face 10 spherically swelled out by 7, 5 and 8 μm at the center portion in comparison with the outer edge portion (ϕ23 mm) as the mean of twenty samples due to the quenching treatment in each of the commercially available silicon nitride, the cemented carbide and the silicon nitride produced in Example 3, respectively, and the total crowning quantities are 14, 10 and 15 μm, respectively.

INDUSTRIAL APPLICABILITY

The present invention forms a crowning shape by applying a known surface quenching treatment to a portion made of the steel in a sliding component, changes this crowning shape by heat-treatment or machining of the steel portion after the surface quenching, forms at least one of the sliding faces forming a crowning shape by a member, preferably by a silicon nitride type ceramic having excellent flexural strength and high thermal shock resistance, and joins or fits this member to the sliding component. Therefore, the present invention provides the following effects.

1) Since the crowning shape is imparted by surface quenching treatment, and the heat-treatment and machining of the steel portion after the surface quenching, the portion to which this crowning shape is to be imparted and the quantity of crowning can be controlled.

2) The shape of the member before machining to be joined or fitted to the portion requiring sliding performance is a flat face, so that three-dimensional pre-machining is not necessary. Therefore, the sliding components can be economically provided.

3) Since the ceramics are joined or fitted as the sliding member to the portion requiring sliding performance, the sliding components can be provided economically.

We claim:

1. A sliding component characterized in that at least one of the members forming a crown-shaped sliding face is joined or fitted to a portion made of steel, the crown-shaped sliding face having been formed by partially applying a surface quenching treatment to said portion made of steel.

2. A sliding component according to claim 1, wherein the surface area to which said surface quenching is applied is at least 30% with the respect to the area obtained by subtracting the portion shaped into the crowning shape from the entire surface of said component.

3. A sliding component according to claim 2 wherein a difference in level between the center portion and an outer edge portion of said sliding face is increased by applying the surface quenching treatment.

4. A sliding component according to claim 2, wherein the crowning quantity is reduced by applying the surface quenching treatment.

5. A sliding component according to claim 1, wherein the crowning quantity is increased by applying heat-treatment after the surface quenching treatment.

6. A sliding component according to claim 1, wherein the crowning quantity is increased by machining a part, or the whole, of the steel portion after the surface quenching treatment.

7. A sliding component according to claim 1, wherein at least one of the members forming the crowning-shaped sliding face by surface quenching treatment is made of a ceramic.

8. A sliding component according to claim 1, wherein at least one of the members forming the crowning-shaped sliding face by surface quenching treatment is made of a silicon nitride type ceramic, and its strength at room temperature and its temperature difference representing thermal shock resistance are at least 100 kg/mm$^2$ and at least 800° C., respectively.

9. A method of producing a sliding component of claim 1 comprising joining or fitting at least one member forming the sliding face to a portion made of steel and is shaped into a crowning shape by applying a partially surface quenching treatment to said portion made of steel.

10. A production method of a sliding component according to claim 9, wherein the surface area to which the surface quenching is applied is at least 30% of the area obtained by subtracting the portion at which crowning is shaped from the entire surface of the sliding component.

11. A production method of a sliding component according to claim 10, wherein the crowning quantity is increased at a certain portion by applying the surface quenching treatment.

12. A production method of a sliding component according to claim 10, wherein the crowning quantity is decreased at a certain portion by applying the surface quenching treatment.

13. A production method of a sliding component according to claim 9, wherein the crowning quantity is increased by heat-treatment after the surface quenching treatment.

14. A production method of a sliding component according to claim 13, wherein the temperature range of said heat-treatment is 100° to 700° C.

15. A production method of a sliding component according to claim 9, wherein the crowning quantity is increased by machining a part, or the whole, of the steel portion after the surface quenching treatment.

16. A production method of a sliding component according to claim 15, wherein said machining method is polishing.

17. A production method of a sliding component according to claim 9, wherein at least one of the members forming the crowning-shaped sliding face by the surface quenching treatment is made of a ceramic.

18. A production method of a sliding component according to claim 9, wherein at least one of the members forming the crowning-shaped sliding face by the surface quenching treatment is made of a silicon nitride ceramic, and its strength at room temperature and its temperature difference representing thermal shock resistance are at least 100 $kg/mm^2$ and at least 800° C. respectively.

* * * * *

UNITED STATES PATENT AND TRADEMARK OFFICE

CERTIFICATE OF CORRECTION

PATENT NO. : 5,783,314

DATED : July 21, 1998

INVENTOR(S) : Masamichi Yamagiwa, et al.

It is certified that error appears in the above-indentified patent and that said Letters Patent is hereby corrected as shown below:

On the title page, item [56], add the following:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 4 | 8 | 5 | 0 | 0 | 9 | 5 | 07/89 | AKAO et al | | | |
| | | | | | | | | | | | | | |

Column 10, line 35, delete "is shaped" and insert --shaping said member--.

Signed and Sealed this

Twenty-sixth Day of October, 1999

*Attest:*

Q. TODD DICKINSON

*Attesting Officer*

*Acting Commissioner of Patents and Trademarks*